US009297228B2

(12) United States Patent
Martinez et al.

(10) Patent No.: US 9,297,228 B2
(45) Date of Patent: Mar. 29, 2016

(54) SHOCK ATTENUATOR FOR GUN SYSTEM

(75) Inventors: Samuel Martinez, Cedar Hill, TX (US); John H. Hales, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 219 days.

(21) Appl. No.: 13/820,748

(22) PCT Filed: Apr. 3, 2012

(86) PCT No.: PCT/US2012/032004

§ 371 (c)(1),
(2), (4) Date: Mar. 4, 2013

(87) PCT Pub. No.: WO2014/003699

PCT Pub. Date: Jan. 3, 2014

(65) Prior Publication Data

US 2014/0262271 A1 Sep. 18, 2014

(51) Int. Cl.

| | |
|---|---|
| ***E21B 29/02*** | (2006.01) |
| ***E21B 43/12*** | (2006.01) |
| ***E21B 43/116*** | (2006.01) |
| ***E21B 43/119*** | (2006.01) |

(52) U.S. Cl.

CPC ..... *E21B 29/02* (2013.01); *E21B 43/116* (2013.01); *E21B 43/119* (2013.01); *E21B 43/1195* (2013.01); *E21B 43/12* (2013.01)

(58) Field of Classification Search

CPC ..... E21B 29/02; E21B 43/116; E21B 43/117; E21B 43/1195; E21B 43/119; E21B 43/12

See application file for complete search history.

(56) References Cited

U.S. PATENT DOCUMENTS

| | | | |
|---|---|---|---|
| 2,833,213 | A | 5/1958 | Udry |
| 2,980,017 | A | 4/1961 | Castel |
| 3,057,296 | A | 10/1962 | Silverman |
| 3,128,825 | A | 4/1964 | Blagg |
| 3,143,321 | A | 8/1964 | McGehee et al. |
| 3,208,378 | A | 9/1965 | Boop |
| 3,216,751 | A | 11/1965 | Der Mott |
| 3,394,612 | A | 7/1968 | Bogosoff et al. |
| 3,414,071 | A | 12/1968 | Alberts |
| 3,599,719 | A | 8/1971 | Brown |
| 3,653,468 | A | 4/1972 | Marshall |

(Continued)

FOREIGN PATENT DOCUMENTS

| | | | |
|---|---|---|---|
| GB | 2406870 | A | 4/2005 |
| WO | 2004076813 | A1 | 9/2004 |

(Continued)

OTHER PUBLICATIONS

Office Action dated Mar. 21, 2014, U.S. Appl. No. 13/210,303, filed Aug. 15, 2011, (Smith IP).

(Continued)

*Primary Examiner* — Yong-Suk (Philip) Ro
(74) *Attorney, Agent, or Firm* — Chamberlain Hrdlicka

(57) ABSTRACT

A perforation gun string includes a perforation gun that forms at least part of the perforation gun string and a swellable material coupled to the perforation gun string. The swellable material is configured to be exposed to a downhole wellbore environment and to swell in response to exposure to the downhole wellbore environment. Further, the swellable material is configured to protrude beyond an outer surface of the perforation gun string when the swellable material swells.

19 Claims, 5 Drawing Sheets

(56) References Cited

U.S. PATENT DOCUMENTS 3,687,074 A 8/1972 Andrews et al.
3,779,591 A 12/1973 Rands
3,923,105 A 12/1975 Lands, Jr.
3,923,106 A 12/1975 Bosse-Platiere
3,923,107 A 12/1975 Dillard
3,971,926 A 7/1976 Gau et al.
4,269,063 A 5/1981 Escaron et al.
4,319,526 A 3/1982 DerMott
4,346,795 A 8/1982 Herbert
4,409,824 A 10/1983 Salama et al.
4,410,051 A 10/1983 Daniel et al.
4,419,933 A 12/1983 Kirby et al.
4,480,690 A 11/1984 Vann
4,575,026 A 3/1986 Brittain et al.
4,598,776 A 7/1986 Stout
4,612,992 A 9/1986 Vann et al.
4,619,333 A 10/1986 George
4,637,478 A 1/1987 George
4,679,669 A 7/1987 Kalb et al.
4,693,317 A 9/1987 Edwards et al.
4,694,878 A 9/1987 Gambertoglio
4,764,231 A 8/1988 Slawinski et al.
4,817,710 A 4/1989 Edwards et al.
4,829,901 A 5/1989 Yates, Jr.
4,830,120 A 5/1989 Stout
4,842,059 A 6/1989 Tomek
4,901,802 A 2/1990 George et al.
4,913,053 A 4/1990 McPhee
4,971,153 A 11/1990 Rowe et al.
5,027,708 A 7/1991 Gonzalez et al.
5,044,437 A 9/1991 Wittrisch
5,078,210 A 1/1992 George
5,088,557 A 2/1992 Ricles et al.
5,092,167 A 3/1992 Finley et al.
5,103,912 A 4/1992 Flint
5,107,927 A 4/1992 Whiteley et al.
5,109,355 A 4/1992 Yuno
5,117,911 A 6/1992 Navarette et al.
5,131,470 A 7/1992 Miszewski et al.
5,133,419 A 7/1992 Barrington
5,161,616 A 11/1992 Colla
5,188,191 A 2/1993 Tomek
5,216,197 A 6/1993 Huber et al.
5,287,924 A 2/1994 Burleson et al.
5,320,169 A 6/1994 Delatorre
5,343,963 A 9/1994 Bouldin et al.
5,351,791 A 10/1994 Rosenzweig
5,366,013 A 11/1994 Edwards et al.
5,421,780 A 6/1995 Vukovic
5,529,127 A 6/1996 Burleson et al.
5,547,148 A 8/1996 Del Monte et al.
5,598,891 A 2/1997 Snider et al.
5,598,894 A 2/1997 Burleson et al.
5,603,379 A 2/1997 Henke et al.
5,667,023 A 9/1997 Harrell et al.
5,774,420 A 6/1998 Heysse et al.
5,813,480 A 9/1998 Zaleski, Jr. et al.
5,823,266 A 10/1998 Burleson et al.
5,826,654 A 10/1998 Adnan et al.
5,957,209 A 9/1999 Burleson et al.
5,964,294 A 10/1999 Edwards et al.
5,992,523 A 11/1999 Burleson et al.
6,012,015 A 1/2000 Tubel
6,021,377 A 2/2000 Dubinsky et al.
6,068,394 A 5/2000 Dublin, Jr.
6,078,867 A 6/2000 Plumb et al.
6,098,716 A 8/2000 Hromas et al.
6,135,252 A 10/2000 Knotts
6,173,779 B1 1/2001 Smith
6,216,533 B1 4/2001 Woloson et al.
6,230,101 B1 5/2001 Wallis
6,283,214 B1 9/2001 Guinot et al.
6,308,809 B1 10/2001 Reid et al.
6,371,541 B1 4/2002 Pedersen
6,394,241 B1 5/2002 Desjardins et al.
6,397,752 B1 6/2002 Yang et al.
6,408,953 B1 6/2002 Goldman et al.
6,412,415 B1 7/2002 Kothari et al.
6,412,614 B1 7/2002 Lagrange et al.
6,450,022 B1 9/2002 Brewer
6,454,012 B1 9/2002 Reid
6,457,570 B2 10/2002 Reid et al.
6,484,801 B2 11/2002 Brewer et al.
6,543,538 B2 4/2003 Tolman et al.
6,550,322 B2 4/2003 Sweetland et al.
6,595,290 B2 7/2003 George et al.
6,672,405 B2 1/2004 Tolman et al.
6,674,432 B2 1/2004 Kennon et al.
6,679,323 B2 1/2004 Vargervik et al.
6,679,327 B2 1/2004 Sloan et al.
6,684,949 B1 2/2004 Gabler et al.
6,684,954 B2 2/2004 George
6,708,761 B2 3/2004 George et al.
6,810,370 B1 10/2004 Watts, III
6,826,483 B1 11/2004 Anderson et al.
6,832,159 B2 12/2004 Smits et al.
6,842,725 B1 1/2005 Sarda
6,868,920 B2 3/2005 Hoteit et al.
6,896,059 B2 5/2005 Brooks et al.
7,000,699 B2 2/2006 Yang et al.
7,006,959 B1 2/2006 Huh et al.
7,044,219 B2 5/2006 Mason et al.
7,114,564 B2 10/2006 Parrott et al.
7,121,340 B2 10/2006 Grove et al.
7,139,689 B2 11/2006 Huang
7,147,088 B2 12/2006 Reid et al.
7,165,612 B2 1/2007 McLaughlin
7,178,608 B2 2/2007 Mayes et al.
7,195,066 B2 3/2007 Sukup et al.
7,234,517 B2 6/2007 Streich et al.
7,246,659 B2 7/2007 Fripp et al.
7,260,508 B2 8/2007 Lim et al.
7,278,480 B2 10/2007 Longfield et al.
7,387,160 B2 6/2008 O'Shaughnessy et al.
7,387,162 B2 6/2008 Mooney, Jr. et al.
7,503,403 B2 3/2009 Jogi et al.
7,509,245 B2 3/2009 Siebrits et al.
7,533,722 B2 5/2009 George et al.
7,600,568 B2 10/2009 Ross et al.
7,603,264 B2 10/2009 Zamora et al.
7,607,379 B2 * 10/2009 Rospek et al. ..... 89/1.15
7,640,986 B2 1/2010 Behrmann et al.
7,721,650 B2 5/2010 Barton et al.
7,721,820 B2 5/2010 Hill et al.
7,762,331 B2 7/2010 Goodman et al.
7,770,662 B2 8/2010 Harvey et al.
7,784,532 B2 8/2010 Sevre et al.
7,806,035 B2 10/2010 Kaiser et al.
8,126,646 B2 2/2012 Grove et al.
8,136,608 B2 3/2012 Goodman
8,181,718 B2 5/2012 Burleson et al.
8,186,259 B2 5/2012 Burleson et al.
8,393,393 B2 3/2013 Rodgers et al.
8,397,800 B2 3/2013 Rodgers et al.
8,397,814 B2 3/2013 Rodgers et al.
8,408,286 B2 4/2013 Rodgers et al.
8,714,251 B2 5/2014 Glenn et al.
8,714,252 B2 5/2014 Glenn et al.
2002/0121134 A1 9/2002 Sweetland et al.
2003/0062169 A1 4/2003 Marshall
2003/0089497 A1 5/2003 George et al.
2003/0150646 A1 8/2003 Brooks et al.
2004/0045351 A1 3/2004 Skinner
2004/0104029 A1 6/2004 Martin
2004/0140090 A1 7/2004 Mason et al.
2006/0048940 A1 3/2006 Hromas et al.
2006/0070734 A1 4/2006 Zillinger et al.
2006/0118297 A1 6/2006 Finci et al.
2006/0243453 A1 11/2006 McKee
2007/0162235 A1 7/2007 Zhan et al.
2007/0193740 A1 8/2007 Quint
2007/0214990 A1 9/2007 Barkely et al.
2007/0267201 A1 11/2007 Brezinski et al.
2007/0283751 A1 12/2007 Van Der Spek

(56) References Cited

U.S. PATENT DOCUMENTS

| | | | | |
|---|---|---|---|---|
| 2008/0041597 | A1 | 2/2008 | Fisher et al. | |
| 2008/0066912 | A1* | 3/2008 | Freyer et al. | 166/297 |
| 2008/0125335 | A1 | 5/2008 | Bhavsar | |
| 2008/0149338 | A1 | 6/2008 | Goodman et al. | |
| 2008/0202325 | A1 | 8/2008 | Bertoja et al. | |
| 2008/0216554 | A1 | 9/2008 | McKee | |
| 2008/0245255 | A1 | 10/2008 | Barton et al. | |
| 2008/0262810 | A1 | 10/2008 | Moran et al. | |
| 2008/0314582 | A1 | 12/2008 | Belani et al. | |
| 2009/0013775 | A1 | 1/2009 | Bogath et al. | |
| 2009/0071645 | A1 | 3/2009 | Kenison et al. | |
| 2009/0084535 | A1 | 4/2009 | Bertoja et al. | |
| 2009/0151588 | A1 | 6/2009 | Burleson et al. | |
| 2009/0151589 | A1 | 6/2009 | Henderson et al. | |
| 2009/0159284 | A1 | 6/2009 | Goodman | |
| 2009/0168606 | A1 | 7/2009 | Lerche et al. | |
| 2009/0182541 | A1 | 7/2009 | Crick et al. | |
| 2009/0223400 | A1 | 9/2009 | Hill et al. | |
| 2009/0266549 | A1* | 10/2009 | Braithwaite et al. | 166/313 |
| 2009/0272529 | A1 | 11/2009 | Crawford | |
| 2009/0272839 | A1 | 11/2009 | Clingman | |
| 2009/0276156 | A1 | 11/2009 | Kragas et al. | |
| 2009/0294122 | A1 | 12/2009 | Hansen et al. | |
| 2010/0000789 | A1 | 1/2010 | Barton et al. | |
| 2010/0011943 | A1 | 1/2010 | Quinn et al. | |
| 2010/0037793 | A1 | 2/2010 | Lee et al. | |
| 2010/0051265 | A1 | 3/2010 | Hurst et al. | |
| 2010/0085210 | A1 | 4/2010 | Bonavides et al. | |
| 2010/0132939 | A1 | 6/2010 | Rodgers | |
| 2010/0133004 | A1 | 6/2010 | Burleson et al. | |
| 2010/0147519 | A1 | 6/2010 | Goodman | |
| 2010/0212891 | A1* | 8/2010 | Stewart et al. | 166/250.12 |
| 2010/0230105 | A1 | 9/2010 | Vaynshteyn | |
| 2011/0120695 | A1 | 5/2011 | Burleson et al. | |
| 2011/0162843 | A1 | 7/2011 | Maier et al. | |
| 2012/0085539 | A1 | 4/2012 | Tonnessen et al. | |
| 2012/0152519 | A1 | 6/2012 | Rodgers et al. | |
| 2012/0152614 | A1 | 6/2012 | Rodgers et al. | |
| 2012/0152615 | A1 | 6/2012 | Rodgers et al. | |
| 2012/0152616 | A1 | 6/2012 | Rodgers et al. | |
| 2012/0158388 | A1 | 6/2012 | Rodgers et al. | |
| 2012/0255722 | A1 | 10/2012 | Rodgers et al. | |
| 2012/0273201 | A1 | 11/2012 | Glenn et al. | |
| 2012/0318508 | A1 | 12/2012 | Glenn et al. | |
| 2013/0048375 | A1 | 2/2013 | Rodgers et al. | |
| 2013/0048376 | A1 | 2/2013 | Rodgers et al. | |
| 2013/0248184 | A1 | 9/2013 | Glenn et al. | |
| 2014/0076564 | A1 | 3/2014 | Rodgers et al. | |
| 2014/0076631 | A1 | 3/2014 | Rodgers et al. | |

FOREIGN PATENT DOCUMENTS

| | | | |
|---|---|---|---|
| WO | 2007056121 | A1 | 5/2007 |
| WO | 2012082143 | A1 | 6/2012 |
| WO | 2012082186 | A1 | 6/2012 |
| WO | 2012082195 | A1 | 6/2012 |
| WO | 2012148429 | A1 | 11/2012 |
| WO | 2014003699 | A2 | 1/2014 |
| WO | 2014046655 | A1 | 3/2014 |
| WO | 2014046656 | A1 | 3/2014 |

OTHER PUBLICATIONS

Office Action dated May 16, 2014, U.S. Appl. No. 13/533,600, filed Jun. 26, 2012, (Smith IP).

Final Office Action dated Mar. 12, 2014, U.S. Appl. No. 13/304,075, filed Nov. 23, 2011, (Smith IP).

Final Office Action dated May 19, 2014, U.S. Appl. No. 13/493,327, filed Jun. 11, 2012, (Smith IP).

Foreign Communication From a Related Counterpart Application—International Preliminary Report on Patentability, PCT/US2011/034690, Oct. 29, 2013.

Foreign Communication from a Related Counterpart Application, International Search dated Jan. 21, 2014, International Application PCT/US12/32004 filed Apr. 3, 2012.

Foreign Communication from a Related Counterpart Application, Chapter II Demand, Article 34 Amendments and Arguments dated Apr. 10, 2014, International Application PCT/US12/32004 filed Apr. 3, 2012.

Foreign Communication from a Related Counterpart Application, Notification of Receipt of Demand by Competent International Preliminary Examining Authority dated Jan. 21, 2014, International Application PCT/US12/32004 filed Apr. 3, 2012.

Notice of Allowance dated Feb. 20, 2014, U.S. Appl. No. 13/895,032, filed May 15, 2013.

FAIPP Pre-Interview Communication dated Jul. 23, 2014, U.S. Appl. No. 14/003,243, filed Sep. 5, 2013.

Office Action dated Jul. 3, 2014, U.S. Appl. No. 13/210,303, filed Aug. 15, 2011, (Smith IP).

Advisory Action dated Jul. 10, 2014, U.S. Appl. No. 13/304,075, filed Nov. 23, 2011, (Smith IP).

Advisory Action dated Jul. 24, 2014, U.S. Appl. No. 13/493,327, filed Jun. 11, 2012, (Smith IP).

"PulsFrac™ Validation: Owen/HTH Surface Block Test," John F. Schatz Research and Consulting, Inc., 2004.

Regalbuto, J.A. et al., "Computer Codes for Oilwell-Perforator Design," Halliburton Explosive Products Center, SPE Drilling & Completion, Sep. 1997, p. 188-195, Halliburton Energy Services, Inc.

Rudshaug, Terje, et al., "NETool™ a toolbox for Improved Reservoir Management," FORCE AWTC Seminar—Advanced Wells—Lessons Learned (application experience) and Future Directions/Opportunities, Apr. 21-22, 2004, DPT US, Inc.

Schatz, J.F. et al., "High-Speed Downhole Memory Recorder and Software Used to Design and Confirm Perforating/Propellant Behavior and Formation Fracturing," Society of Petroleum Engineers, Inc., 1999.

Schatz, J.F. et al., "High-Speed Pressure and Accelerometer Measurements Characterize Dynamic Behavior During Perforating Events in Deepwater Gulf of Mexico," SPE 90042, Society of Petroleum Engineers, 2004.

Schatz, John, "The Role of Compressibility in PulsFrac® Software," John F. Schatz Research and Consulting, Inc., Aug. 22, 2007.

"Series 200 High Shock, High Speed Pressure and Acceleration Gauge", IES, Instrumentation and Engineering Services Inc., Aug. 2004, U.S.A.

"Series 300 Gauge," http://www.iesrecorderes.com/oilwell.htm (last visited Sep. 1, 2010), IES Recorders—Oil Well.

"Series 300 High Shock, High Speed Pressure Gauge", Instrumentation and Engineering Services Inc., Feb. 2010, Navarre, FL, U.S.A.

Shepherd, Joseph E., "Structural Response of Piping to Internal Gas Detonation," Proceedings of PVP2006-ICPVT-11, 2006 ASME Pressure Vessels and Piping Division Conference, Jul. 23-27, 2006, Vancouver BC, Canada.

"ShockPro Shockload Evaluation Service—Engineer Perforated Completions to Evaluate the Mechanical Integrity of All System Components," Wireline and Perforating Services, Halliburton Energy Services, Inc.

"ShockPro Shockload Evaluation Service" Perforating Solutions 5-125, Halliburton Energy Services, Inc.

"Simulation Software for EquiFlow® ICD Completions," Advanced Completions, HO7010, Halliburton, Sep. 2009.

"SXVA Explosively Initiated Vertical Shock Absorber", product paper 06-WT-066, Schlumberger, 2007.

"WEM—Well Evaluation Model," P.E. Moseley & Associates, Inc., Houston, TX U.S.A.

Rodgers, John P., et al. PCT Application entitled, "Perforation Gun String Energy Propagation Management System and Methods", filed Sep. 19, 2012, Int'l Application No. PCT/US12/56165.

Rodgers, John P., et al., Patent Application entitled, "Perforation Gun String Energy Propagation Management System and Methods", filed Sep. 11, 2013, U.S. Appl. No. 14/004,678.

Rodgers, John P., et al., PCT Application entitled, "Perforation Gun String Energy Propagation Management with Tuned Mass Damper", filed Sep. 19, 2012, Int'l Application No. PCT/US12/56164.

(56) References Cited

OTHER PUBLICATIONS

Rodgers, John P., et al., Patent Application entitled, "Perforation Gun String Energy Propagation Management with Tuned Mass Damper", filed Sep. 5, 2013, U.S. Appl. No. 14/003,234.
Rodgers, John P., et al., Patent Application entitled, "Perforation Gun String Energy Propagation Management with Tuned Mass Damper", filed Sep. 18, 2013, U.S. Appl. No. 14/031,034.
Martinez, Samuel, et al., PCT Application entitled, "Shock Attenuator for Gun System", filed Apr. 3, 2012, Int'l Application No. PCT/US12/32004.
Notice of Allowance dated Sep. 26, 2013, U.S. Appl. No. 13/377,148, filed Dec. 8, 2011.
Notice of Allowance dated Oct. 2, 2013, U.S. Appl. No. 13/594,776, filed Aug. 25, 2012.
Office Action dated Sep. 30, 2013, U.S. Appl. No. 13/895,032, filed May 15, 2013.
Final Office Action dated Sep. 13, 2013, U.S. Appl. No. 13/210,303, filed Aug. 15, 2011.
Office Action dated Oct. 1, 2012, U.S. Appl. No. 13/325,866, filed Dec. 14, 2011.
Rodgers, John P., et al., PCT Application entitled "Sensing Shock During Well Perforation", filed Dec. 17, 2010, App. No. PCT/US10/66102.
Burleson, John D., et al., PCT Application entitled, "Modeling Shock Produced by Well Perforating," filed Dec. 17, 2010, Int'l Application No. PCT/US2010/061104.
Glenn, Timothy S., et al., Patent Application entitled, "Shock Load Mitigation in a Downhole Perforation Tool Assembly", filed May 15, 2013, U.S. Appl. No. 13/895,032.
Office Action Restriction dated Jul. 30, 2009, U.S. Appl. No. 11/957,541, filed Dec. 17, 2007.
Office Action dated Sep. 8, 2009, U.S. Appl. No. 11/957,541, filed Dec. 17, 2007.
Office Action dated Feb. 2, 2010, U.S. Appl. No. 11/957,541, filed Dec. 17, 2007.
Office Action dated Jul. 15, 2010, U.S. Appl. No. 11/957,541, filed Dec. 17, 2007.
Office Action dated Nov. 22, 2010, U.S. Appl. No. 11/957,541, filed Dec. 17, 2007.
Notice of Allowance dated Feb. 7, 2011, U.S. Appl. No. 11/957,541, filed Dec. 17, 2007.
Office Action dated May 4, 2011, U.S. Appl. No. 11/957,541, filed Dec. 17, 2007.
Final Office Action dated Oct. 24, 2011, U.S. Appl. No. 11/957,541, filed Dec. 17, 2007.
Notice of Allowance dated Jan. 27, 2012, U.S. Appl. No. 11/957,541, filed Dec. 17, 2007.
Office Action dated Apr. 21, 2011, U.S. Appl. No. 13/008,075, filed Jan. 18, 2011.
Final Office Action dated Oct. 24, 2011, U.S. Appl. No. 13/008,075, filed Jan. 18, 2011.
Advisory Action dated Jan. 17, 2012, U.S. Appl. No. 13/008,075, filed Jan. 18, 2011.
Notice of Allowance dated Jan. 25, 2012, U.S. Appl. No. 13/008,075, filed on Jan. 18, 2011.
Office Action dated Jun. 13, 2012, U.S. Appl. No. 13/377,148, filed Dec. 8, 2011.
Final Office Action dated Jan. 18, 2013, U.S. Appl. No. 13/377,148, filed Dec. 8, 2011.
Notice of Allowance dated Apr. 2, 2013, U.S. Appl. No. 13/377,148, filed Dec. 8, 2011.
Restriction Requirement dated Jan. 31, 2013, U.S. Appl. No. 13/594,776, filed Aug. 25, 2012.
Office Action dated Mar. 26, 2013, U.S. Appl. No. 13/594,776, filed Aug. 25, 2012.
Notice of Allowance dated Jul. 11, 2013, U.S. Appl. No. 13/594,776, filed Aug. 25, 2012.
Office Action dated Jan. 27, 2012, U.S. Appl. No. 13/210,303, filed Aug. 15, 2011.
Final Office Action dated Aug. 2, 2012, U.S. Appl. No. 13/210,303, filed Aug. 15, 2011.
Office Action dated Apr. 4, 2013, U.S. Appl. No. 13/210,303, filed Aug. 15, 2011.
Office Action dated Apr. 10, 2012, U.S. Appl. No. 13/325,726, filed Dec. 14, 2011.
Final Office Action dated Jul. 26, 2012, U.S. Appl. No. 13/325,726 filed Dec. 14, 2011.
Office Action dated Oct. 1, 2012, U.S. Appl. No. 13/325,726, filed Dec. 14, 2011.
Notice of Allowance dated Jan. 23, 2013, U.S. Appl. No. 13/325,726, filed Dec. 14, 2011.
Office Action dated Jun. 29, 2012, U.S. Appl. No. 13/325,866, filed Dec. 14, 2011.
Final Office Action dated Oct. 23, 2012, U.S. Appl. No. 13/325,866, filed Dec. 14, 2011.
Notice of Allowance dated Jan. 24, 2013, U.S. Appl. No. 13/325,866, filed Dec. 14, 2011.
Office Action dated Sep. 6, 2012, U.S. Appl. No. 13/495,035, filed Jun. 13, 2012.
Final Office Action dated Dec. 14, 2012, U.S. Appl. No. 13/495,035.
Notice of Allowance dated Feb. 15, 2013, U.S. Appl. No. 13/495,035.
Office Action dated Jun. 6, 2012, U.S. Appl. No. 13/325,909, filed Dec. 14, 2011.
Final Office Action dated Nov. 19, 2012, U.S. Appl. No. 13/325,909, filed Dec. 14, 2011.
Notice of Allowance dated Feb. 1, 2013, U.S. Appl. No. 13/325,909, filed Dec. 14, 2011.
Office Action dated Dec. 18, 2012, U.S. Appl. No. 13/533,600, filed Jun. 26, 2012.
Final Office Action dated Jun. 20, 2013, U.S. Appl. No. 13/533,600, filed Jun. 26, 2012.
Office Action dated Feb. 24, 2012, U.S. Appl. No. 13/304,075, filed Nov. 23, 2011.
Office Action dated Dec. 12, 2012, U.S. Appl. No. 13/493,327, filed Jun. 11, 2012.
Final Office Action dated Jun. 11, 2013, U.S. Appl. No. 13/493,327, filed Jun. 11, 2012.
Notice of Allowance dated Jan. 23, 2014, U.S. Appl. No. 13/377,148, filed Dec. 8, 2011.
Notice of Allowance dated Jan. 23, 2014, U.S. Appl. No. 13/594,776, filed Aug. 25, 2012.
Advisory Action dated Nov. 27, 2013, U.S. Appl. No. 13/210,303, filed Aug. 15, 2011.
Office Action dated Nov. 7, 2013, U.S. Appl. No. 13/304,075, filed Nov. 23, 2011.
Foreign Communication From a Related Counterpart Application—International Search Report and Written Opinion, PCT/US2011/034690, Oct. 27, 2011.
Foreign Communication From a Related Counterpart Application—International Search Report and Written Opinion, PCT/US2010/061104, Jul. 28, 2011.
Foreign Communication From a Related Counterpart Application—International Search Report and Written Opinion, PCT/US2010/061102, Jul. 28, 2011.
Foreign Communication From a Related Counterpart Application—International Search Report and Written Opinion, PCT/US2011/029412, Nov. 22, 2011.
Foreign Communication From a Related Counterpart Application—International Search Report and Written Opinion, PCT/US2011/046955, Dec. 27, 2011.
Foreign Communication From a Related Counterpart Application—International Search Report and Written Opinion, PCT/US2011/061107, Jul. 28, 2011.
Foreign Communication From a Related Counterpart Application—International Search Report and Written Opinion, PCT/US2011/050395, Feb. 17, 2012 (Smith IP).
Foreign Communication From a Related Counterpart Application—International Search Report and Written Opinion, PCT/US2011/049882, Feb. 20, 2012 (Smith IP).
Foreign Communication From a Related Counterpart Application—International Search Report and Written Opinion, PCT/US2011/050401, Feb. 9, 2012 (Smith IP).

(56) References Cited

OTHER PUBLICATIONS

Foreign Communication from a Related Counterpart Application, International Search Report and Written Opinion dated Apr. 10, 2013, International Application PCT/US12/56165 filed on Sep. 19, 2012.
Foreign Communication from a Related Counterpart Application, International Search Report and Written Opinion dated Apr. 5, 2013, International Application PCT/US12/56164 filed Sep. 19, 2012.
"2010 International Perforating Symposium", Agenda, dated May 6-7, 2010 2 pages.
"Accelerometer Wire Termination," IES, AN106.
Ager, Scott, IES "Fast Speed Gages," Power Point Presentation; Mar. 2, 2009, Navarre, FL, U.S.A.
Ager, Scott, "IES Housing and High Shock Considerations," Power Point Presentation.
Ager, Scott, "IES Introduction," Power Point Presentation, IES, U.S.A.
Ager, Scott, "IES Recorder Buildup," Power Point Presentation, U.S.A.
Ager, Scott, "Model 64 and 67 Buildup," Power Point Presentation, Oct. 17, 2006, U.S.A.
Ager, Scott, "IES Sensor Discussion," Power Point Presentation. U.S.A.
"Analog Recorder Test Example," http://www.iesrecorders.com/highschock.htm (last visited Sep. 1, 2010), IES Recorders—Highshock.
Ansah, Joseph et al., "Advances in Well Completion Design: A New 3D Finite-Element Wellbore Inflow Model for Optimizing Performance of Perforated Completions," Society of Petroleum Engineers, 2002.
"AutoLatchTM Release Gun Connector", Special Applications 6-7, Halliburton.
"Battery Packaging for High Shock", IES, AN102.
Baumann, Carlos, et al., "Perforating Wellbore Dynamics and Gunshock in Deepwater TCP Operations," Product Information Presentation, IPS-10-018, Schlumberger Reservoir Completions.
Blakeborough, A. et al., "Novel Load Cell for Measuring Axial Force, Shear Force, and Bending Movement in Large-scale Structural Experiments," Experimental Mechanics, vol. 42, No. 1, p. 115-122, Mar. 2002.
"Body Lock Ring", Mechanical Downhole Technology Transfer, Halliburton.
Bruyere, Frederic et al., "New Practices to Enhance Perforating Results", Oilfield Review, p. 18-35, Autumn 2006.
Canal, et al., "Predicting Pressure Behavior and Dynamic Shock Loads on Completion Hardware During Perforating," May 3-6, 2010.
"Casing Differential in PulsFrac™ Calculations," John F. Schatz Research and Consulting, Inc. 2004.
Cuthill, D.A. et al., "A New Technique for Rapid Estimation of Fracture Closure Stress When Using Propellants," SPE/ISRM 78171, Society of Petroleum Engineers, 2002.
Dobrilovic, Mario et al., "Measurements of Shock Wave Force in Shock Tube with Indirect Methods," Rudarsko-geolosko-naftni zbornik, vol. 17, 2005. University of Zagreb; Zagreb, Croatia.
"Downhole Mechanical Shock Absorber". Preliminary Report—patent and prior art search results, dated Jul. 8, 2010, Starboard Innovations, LLC.
"Ecrin Dynamic Flow Analysis Platform," http://www.essca.com/en/ecrin_en.asp (last visited Oct. 28, 2010) ESSCA, 2009.
"Electronic Initiation System," Special Devices, Inc., http://www.specialdevices.com/mining.htm (last visited May 18, 2011) Mesa, AZ, U.S.A.
"Fast Gauge Recorder," Perforating Solutions 5-110, Halliburton.
Furui, Kenji, "A Comprehensive Skin Factor Model for Well Completions Based on Finite Element Simulations," University of Texas at Austin, 2004.
Grove, B. et al., "Explosion-induced damage to oilwell perforating gun carriers," Structures Under Shock and Impact IX, WIT Transactions on the Built Environment, vol. 87, p. 165-176, WIT Press, 2006.
Grove, B. et al., "New Effective Stress Law for Predicting Perforation Depth at Downhole Conditions," SPE 111778, Society of Petroleum Engineers, 2008.
"Integrated Production Modeling Brochure," Petroleum Experts Ltd., 2008.
Jin, Quiankun et al., "3D Numerical Simulations of Penetrations of Oil-Well Perforator into Concrete Targets," 7th International LS-DYNA Users Conference, Beijing Engineering Software Technology Co., Ltd., Beijing, China.
Li, W et al., "The effect of annular multi-point initiation on the formation and penetration of an explosively formed penetrator," International Journal of Impact Engineering, 2009, doi:10.10161j.ijimpeng.2009.08.008.
Murilo, Sergio et al., "Optimization and Automation of Modeling of Florw in Perforated Oil Wells," Virtual Product Development Conference, 2004. MSC Software, Huntingon Beach, California, U.S.A.
Ouyang, Liang-Biao et al., "Case Studies for Improving Completion Design Through Comprehensive Well-Performance Modeling," SPE 104078, Society of Petroleum Engineers, 2006.
Ouyang, Liang-Biao et al., "Uncertainty Assessment on Well-Performance Prediction for an Oil Producer Equipped With Selected Completions," SPE 106966, Society of Petroleum Engineers, 2007.
"Pert Breakdown, Fracturing, and Cleanup in PulsFrac®," John F. Schatz Research and Consulting, Inc., May 2, 2007.
"Petroleum Exploration & Production Software, Training & Consulting," v4.12-B, KAPPA Engineering, Jan. 2010.
"Positioning Strain Gages to Monitor Bending, Axial, Shear, and Torsional Loads," Strain Gages E.
"Problems in High-shock Management," Endevco, MEGGITT.
Proett, M.A. et al., "Productivity Optimization of Oil Wells Using a New 3D Finit-Element Wellbore Inflow Model and Artificial Neural Network," Halliburton Energy Services, Inc.
"PulsFrac™ Summary Technical Description", John F. Schatz Research and Consulting, Inc., 2004.

* cited by examiner

SHOCK ATTENUATOR FOR GUN SYSTEM

CROSS-REFERENCE TO RELATED APPLICATIONS

This application is a 371 National Stage of International Application No. PCT/US2012/032004, entitled, "Shock Attenuator for Gun System," by Samuel Martinez, et al., filed on Apr. 3, 2012, which is incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. In some cases, a multilateral well may be drilled comprising a plurality of wellbores drilled off of a main wellbore, each of which may be referred to as a lateral wellbore. Portions of lateral wellbores may be substantially horizontal to the surface. In some provinces, wellbores may be very deep, for example extending more than 10,000 feet from the surface.

A variety of servicing operations may be performed on a wellbore after it has been initially drilled. A lateral junction may be set in the wellbore at the intersection of two lateral wellbores and/or at the intersection of a lateral wellbore with the main wellbore. A casing string may be set and cemented in the wellbore. A liner may be hung in the casing string. The casing string may be perforated by firing a perforation gun. A packer may be set and a formation proximate to the wellbore may be hydraulically fractured. A plug may be set in the wellbore. Typically it is undesirable for debris, fines, and other material to accumulate in the wellbore. Fines may comprise more or less granular particles that originate from the subterranean formations drilled through or perforated. The debris may comprise material broken off of drill bits, material cut off casing walls, pieces of perforating guns, and other materials. A wellbore may be cleaned out or swept to remove fines and/or debris that have entered the wellbore. Those skilled in the art may readily identify additional wellbore servicing operations. In many servicing operations, a downhole tool is conveyed into the wellbore and then is activated by a triggering event to accomplish the needed wellbore servicing operation.

SUMMARY

In an embodiment, a perforation gun string is disclosed. The perforation gun string comprises a perforation gun that forms at least part of the perforation gun string; and a swellable material coupled to the perforation gun string. The swellable material is configured to be exposed to a downhole wellbore environment; the swellable material is configured to swell in response to exposure to the downhole wellbore environment; and the swellable material is configured to protrude beyond an outer surface of the perforation gun string when it swells In an embodiment, a downhole tool is disclosed. The downhole tool comprises a tandem for use in making up a perforation gun and swellable material coupled to the tandem. The swellable material is configured to swell in response to being exposed to a downhole wellbore environment and configured to permit fluid flow between an annular region above the swellable material and an annular region below the swellable material after the swellable material swells.

In an embodiment, a method of perforating a wellbore is disclosed. The method comprises running a perforation gun string into the wellbore to a perforation depth, the perforation gun string comprising a swellable material coupled to the perforation gun string, allowing the swellable material to swell, and, after swelling the swellable material, perforating the wellbore.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
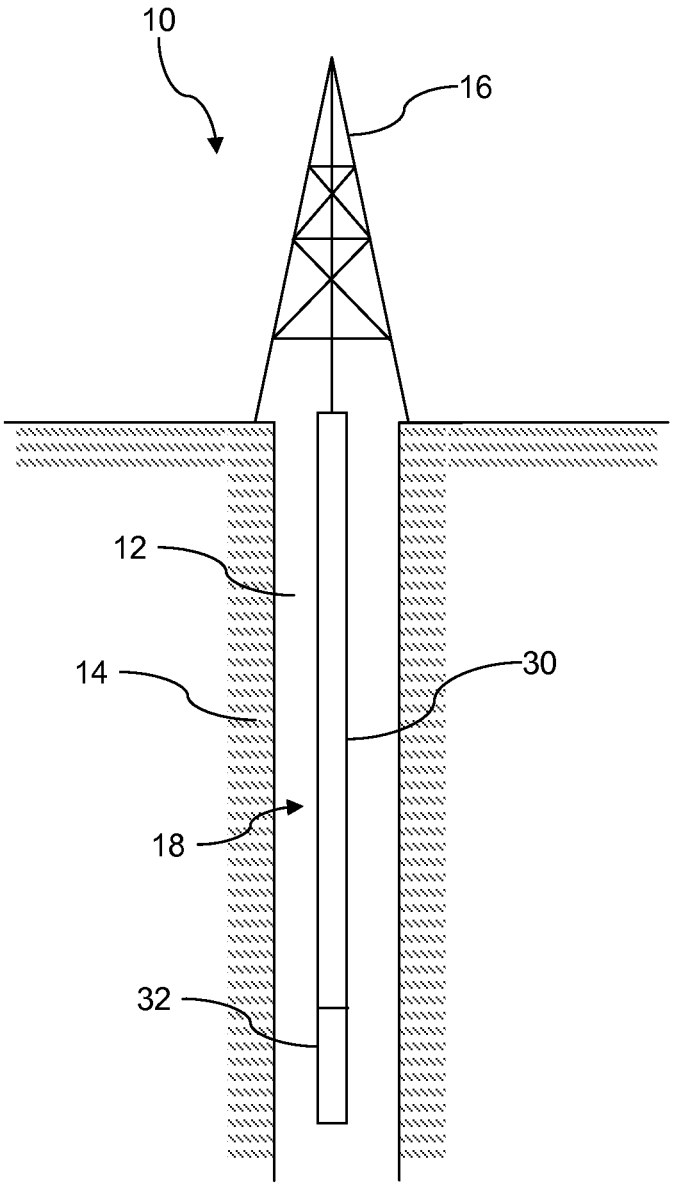
FIG. 1 is an illustration of a wellbore, a conveyance, and a perforation gun string according to an embodiment of the disclosure.

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation, such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Perforation guns are employed to perforate metal casing strings and/or to improve the flow of hydrocarbons from subterranean formations. Perforation guns may include a plurality of explosive charges that explode with high energy. This sudden release of explosive energy may undesirably move the perforation gun, a perforation gun string, and/or a tool string in the wellbore, possibly causing damage. For example, a lower portion of the perforation gun string may be slammed into the casing, and a piece of the perforation gun string may break off and fall into the wellbore. Alternatively, other undesirable damage may be caused to the perforation gun string and/or the tool string.

The present disclosure teaches providing shock attenuators or shock absorbers coupled to an outside of the perforation gun string to absorb and attenuate shock impacts of the perforation gun string banging into a wall of the wellbore and/or the casing. The shock attenuators may also contribute to maintaining the perforation gun string in a properly aligned position within the wellbore and/or casing, for example centrally disposed rather than laying on the side of the casing in a horizontal or diverted wellbore. The shock attenuation may be provided by swellable material that is coupled into cavities in the surface of the perforation gun string, for example in cavities and/or recesses machined in the surface of tandems. When the perforation gun string is run-in to the wellbore, the swellable material has not swelled or has not swelled to a significant extent, and hence the swellable material may not interfere with running the perforation gun string into the wellbore. When the perforation gun string has been run in to the depth at which the perforation will take place, the perforation gun string may be held in position for an interval of time suitable to allow the swellable material to swell sufficiently, for example in response to the presence of fluids that cause the swellable material to swell. The wellbore is then perforated, and the swollen material attenuates and/or absorbs impacts of the perforation gun string into the wellbore and/or into the casing.

Turning now to FIG. 1, a wellbore servicing system 10 is described. The system 10 comprises a servicing rig 16 that extends over and around a wellbore 12 that penetrates a subterranean formation 14 for the purpose of recovering hydrocarbons, storing hydrocarbons, disposing of carbon dioxide, or the like. The wellbore 12 may be drilled into the subterranean formation 14 using any suitable drilling technique. While shown as extending vertically from the surface in FIG. 1, in some embodiments the wellbore 12 may be deviated, horizontal, and/or curved over at least some portions of the wellbore 12. The wellbore 12 may be cased, open hole, contain tubing, and may generally comprise a hole in the ground having a variety of shapes and/or geometries as is known to those of skill in the art.

The servicing rig 16 may be one of a drilling rig, a completion rig, a workover rig, a servicing rig, or other mast structure that supports a workstring 18 in the wellbore 12. In other embodiments a different structure may support the workstring 18, for example an injector head of a coiled tubing rigup. In an embodiment, the servicing rig 16 may comprise a derrick with a rig floor through which the workstring 18 extends downward from the servicing rig 16 into the wellbore 12. In some embodiments, such as in an off-shore location, the servicing rig 16 may be supported by piers extending downwards to a seabed. Alternatively, in some embodiments, the servicing rig 16 may be supported by columns sitting on hulls and/or pontoons that are ballasted below the water surface, which may be referred to as a semi-submersible platform or rig. In an off-shore location, a casing may extend from the servicing rig 16 to exclude sea water and contain drilling fluid returns. It is understood that other mechanical mechanisms, not shown, may control the run-in and withdrawal of the workstring 18 in the wellbore 12, for example a draw works coupled to a hoisting apparatus, a slickline unit or a wireline unit including a winching apparatus, another servicing vehicle, a coiled tubing unit, and/or other apparatus.

In an embodiment, the workstring 18 may comprise a conveyance 30, a perforation gun string 32, and other tools and/or subassemblies (not shown) located above or below the perforation gun string 32. The conveyance 30 may comprise any of a string of jointed pipes, a slickline, a coiled tubing, a wireline, and other conveyances for the perforation gun string 32. In an embodiment, the perforation gun string 32 comprises one or more explosive charges that may be triggered to explode, perforating a wall of the wellbore 12 and forming perforations or tunnels out into the formation 14. The perforating may promote recovering hydrocarbons from the formation 14 for production at the surface, storing hydrocarbons flowed into the formation 14, or disposing of carbon dioxide in the formation 14, or the like. The perforation may provide a pathway for gas injection.

Turning now to FIG. 2A, FIG. 2B, FIG. 2C, and FIG. 2D, a first embodiment of the perforation gun string 32 comprises a first perforation gun 50*a*. In an embodiment, the first perforation gun 50*a* comprises a first tandem 52*a*, a second tandem 52*b*, and a perforation gun barrel 54 coupled between the tandems 52. The tandems 52 each comprise a plurality of shock attenuator material 56. The perforation gun barrel 54 comprises one or more explosive charges 58 that may be fired to perforate the subterranean formation 14 and/or a casing in the wellbore 12. The perforation gun barrel 54 may comprise a tool body housing a plurality of explosive charges 58. The explosive charges 58 may be retained by a charge carrier structure (not shown) within the tool body. The tool body may have scallops in its outer surface that may be proximate to the explosive charges 58. The scallops may be areas where the tool body is thinner and/or where the tool body defines a shallow concavity.

Tandems are known to those skilled in the art. In an embodiment, a tandem may be a short section of pipe or a subassembly that is substantially solid metal with the exception of having a relatively small diameter channel running from end to end for containing detonation cord and/or for containing electrical conductors. A tandem may have an indentation or groove that promotes engaging and supporting the tandem, and hence supporting the perforation gun to which the tandem is coupled, for example engaging the tandem with elevators coupled to a travelling block of a drilling rig.

Figure 2A:
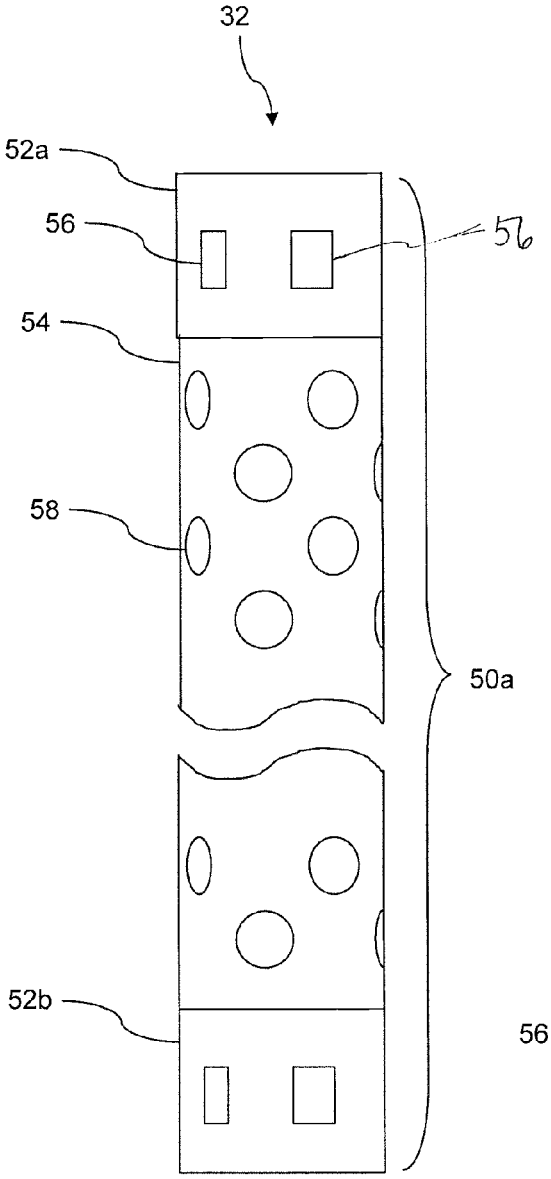
FIG. 2A is an illustration of a first perforation gun string according to an embodiment of the disclosure.
Figure 2B:
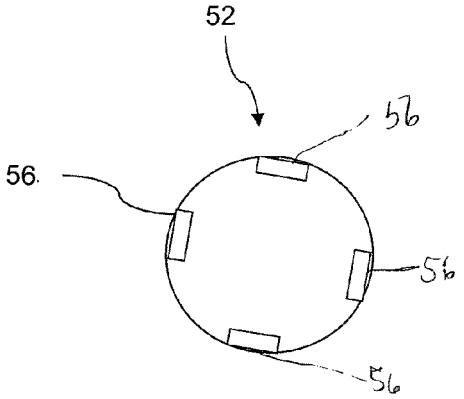
FIG. 2B is an illustration of a tandem of a perforation gun in a first state according to an embodiment of the disclosure.
Figure 2C:
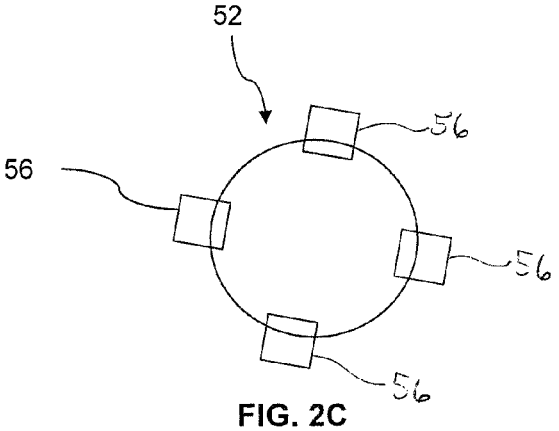
FIG. 2C is an illustration of a tandem of a perforation gun in a second state according to an embodiment of the disclosure.
Figure 2D:
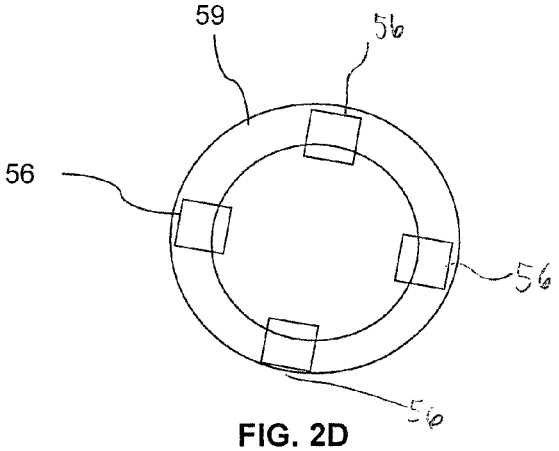
FIG. 2D is an illustration of a tandem of a perforation gun in the second state within a casing according to an embodiment of the disclosure.

As best seen in FIG. 2B, during run-in of the perforation gun string 32, the shock attenuator material 56 is substantially retracted and/or flush with an outside radial surface of the tandems 52. As best seen in FIG. 2C, when the perforation gun string 32 has been run-in to the position where the wellbore subterranean formation 14 and/or casing is to be perforated, the shock attenuator material 56 is deployed to protrude beyond the outside radial surface of the tandems 52. As best seen in FIG. 2D, after firing the perforation gun 50, the perforation gun string 32 may move within the wellbore 12, and the shock attenuator material 56 may contact a casing wall 59 first, before the perforation gun string 32 contacts or bumps into the wellbore 12. Thus, the shock attenuator material 56 may attenuate the impact that might otherwise be delivered to the perforation gun string 32. In an embodiment, the shock attenuator material 56 is placed such that fluid flow in the wellbore 12 is not impeded, for example fluid flow up and down the annulus defined by the wellbore 12 and the outside of the perforation gun string 32, past the tandems 52*a*, 52*b*, is not blocked substantially by the shock attenuator material 56. In an embodiment, the shock attenuator material 56 may be configured to leave a gap for fluid flow between an outer surface of the shock attenuator material 56 and the wellbore 12 and/or the shock attenuator material 56 may be configured to provide for one or more longitudinal fluid channels or gaps between adjacent sections of the shock attenuator material 56 to allow for fluid flow therebetween.

While the shock attenuator material 56 is illustrated in FIG. 2A as being rectangular in shape, it is understood that the shock attenuator material 56 may be implemented in any shape, for example in a circular shape, a square shape, a rectangular shape, an oval shape, a star shape, a longitudinal strip shape, and/or a circumferential ring shape (though the circumferential ring shape may have passageways therethrough). In an embodiment, the shock attenuator material 56 may be beveled or feature ramped edges. Beveled and/or ramped edges may reduce the opportunity for the shock attenuator material 56 to hang in the wellbore 12 and/or on casing joints as the perforation gun string 32 is run into the wellbore 12. Additionally, while shown arranged in a single row of pads of shock attenuator material 56, the pads of shock attenuator material 56 may be arranged differently, for example in a plurality of rows, with the pads in different rows offset from each other or lined up with each other. The tandem 52 may be machined to create cavities or recesses into which the shock attenuator material 56 may be positioned so that it is initially retracted or flush with the surface of the tandem 52.

The shock attenuator material 56 may have grooves or ridges molded or cut into its surface. The shock attenuator material 56 may be molded and/or cut to create a surface having a number of isolated protuberances or high points. These surface features may promote the abrasion and removal of the shock attenuator material 56 as the perforation gun string 32 is removed from the wellbore 12 after perforation has completed, thereby reducing the possibility that the shock attenuator material 56 may cause the perforation gun string 32 to get stuck in the wellbore 12. These surface features may promote adjusting the amount of shock attenuation and/or adjusting the shock attenuation on-set with reference to displacement of the perforation gun string 32 in the wellbore 12.

In an embodiment, the shock attenuator material 56 may be layered or laminated, for example having an outer layer and an inner layer. In an embodiment, the outer layer may be relatively hard while the inner layer may be relatively soft. The hard outer layer may resist scuffing and/or abrasion as the perforation gun string 32 is run into the wellbore 12. When the perforation gun string 32 is pulled out of the wellbore 12, after the shock attenuator material 56 has swollen, the outer harder layer may readily peel off when contacting the wellbore 12 and/or casing, thereby promoting the movement of the perforation gun string 32 out of the wellbore 12. In an embodiment, the inner softer layer may be selected to shear in response to a shear force on the shock attenuator material 56, thereby providing for a specific shear location.

While in FIG. 2A, both the tandems 52*a*, 52*b* are illustrated as having shock attenuator material 56, in an alternative embodiment only one of the two tandems 52*a*, 52*b* have shock attenuator material 56. Alternatively, in an embodiment, the shock attenuator material 56 may be coupled to the perforation gun barrel 54 at a top edge and/or a bottom edge of the perforation gun barrel 54, for example coupled in scallops in the surface of the perforation gun barrel 54. When the shock attenuator material 56 is coupled in scallops in the surface of the perforation gun barrel 54, explosive charges 58 may not be located proximate to those scallops. Alternatively, the shock attenuator material 56 may be located among the explosive charges 58 but preferably not blocking the explosive charges 58.

In combination with the present disclosure, one skilled in the art will readily be able to determine the amount of shock attenuator material 56 to use in assembling the gun string 32. The amount of shock attenuator material 56 may be determined based on an analysis of the magnitude of the mechanical energy that is expected to be released during a perforation event. For example, a perforation gun expected to release a relatively greater amount of mechanical energy may be assembled with relatively more shock attenuator material 56; a perforation gun expected to release a relatively lesser amount of mechanical energy may be assembled with relatively less shock attenuator material 56. The amount of shock attenuator material 56 to use may also be determined based on the properties of the shock attenuator material 56, for example the energy absorbing properties and/or the hardness of the shock attenuator material 56.

Likewise, the location and/or positioning of the shock attenuator material 56 in the gun string 32 may be determined based on an analysis of the disposition or location of the mechanical energy that is expected to be released during a perforation event. The analysis may indicate appropriate intervals along the gun string 32 to locate shock attenuator material 56, for example every 5 feet, every 10 feet, every 20 feet, or at some other interval.

In an embodiment, the gun string 32, including the incorporated shock attenuator material 56, may be modeled and a perforation event simulated with a computer program to evaluate the suitability of the amount and location of the shock attenuator material 56. For example, a Shock Pro simulation program may be employed to simulate the perforation event. In an embodiment, sacrificial mechanical structures may be incorporated into the gun string 32 to determine actual engagement of the gun string 32 with the wellbore 12 as a result of an actual perforation event. For example, a series of different length mechanical probes may be deployed. If one of the mechanical probes contacts the wellbore 12 or casing, the probe may be broken off or deformed in some distinguishable manner. Determining the shortest mechanical probe that contacts the wellbore 12 may provide an indication of the movement of the gun string 32 in the wellbore 12 resulting from firing the perforation gun 50 and may also provide an indication of the effectiveness of the shock attenuator material 56. This information could be incorporated back into the perforation event simulation tool to improve future perforation event simulations and gun string designs.

In an embodiment, the shock attenuator material 56 may comprise a swellable material and/or a combination of swellable materials, for example a swellable material that is not swollen and is retracted below the outside surface of the tandem 52 upon the initiation of run-in and that remains substantially retracted until the perforation gun string 32 is run-in to the perforation location. Alternatively, the shock attenuator material 56 may comprise a combination of swellable material and non-swellable material in which the swellable material may motivate the deployment of the shock attenuator material 56, and the non-swellable material may principally promote shock absorption. The swellable material may then swell in response to downhole environmental conditions, for example in response to a downhole temperature, in response to contact with water in the downhole environment, in response to contact with hydrocarbons in the downhole environment, and/or in response to other downhole environmental conditions. Alternatively, the shock attenuator material 56 may be deployed mechanically, for example by actuation of a spring.

In an embodiment, the shock attenuator material 56 may be any of a variety of swellable materials that are activated and swell in the presence of water and/or hydrocarbons. For example, low acrylic-nitrile may be used which swells by as much as fifty percent when contacted by xylene. For example, simple ethylene propylene diene rubber (EDPM) compound may be used which swells when contacted by hydrocarbons. For example, a swellable polymer, such as cross-linked polyacrylamide may be used which swells when contacted by water. In each of the above examples, the swellable material swells by action of the shock attenuator material 56 absorbing and/or taking up liquids. In an embodiment, the swellable material may be activated to swell by one or more of heat and/or pressure.

It is to be understood that although a variety of materials other than the swellable material of the present disclosure may undergo a minor and/or insignificant change in volume upon contact with a liquid or fluid, such minor changes in volume and such other materials are not referred to herein by discussions referencing swelling or expansion of the swellable material. Such minor and insignificant changes in volume are usually no more than about 5% of the original volume.

In an embodiment, the swellable material may comprise a solid or semi-solid material or particle which undergoes a reversible, or alternatively, an irreversible, volume change upon exposure to a swelling agent (a resilient, volume changing material). Nonlimiting examples of such resilient, volume changing materials include natural rubber, elastomeric materials, styrofoam beads, polymeric beads, or combinations thereof. Natural rubber includes rubber and/or latex materials derived from a plant. Elastomeric materials include thermoplastic polymers that have expansion and contraction properties from heat variances. Other examples of suitable elastomeric materials include styrene-butadiene copolymers, neoprene, synthetic rubbers, vinyl plastisol thermoplastics, or combinations thereof. Examples of suitable synthetic rubbers include nitrile rubber, butyl rubber, polysulfide rubber, EPDM rubber, silicone rubber, polyurethane rubber, or combinations thereof. In some embodiments, the synthetic rubber may comprise rubber particles from processed rubber tires (e.g., car tires, truck tires, and the like). The rubber particles may be of any suitable size for use in a wellbore fluid. An example of a suitable elastomeric material is employed by Halliburton Energy Services, Inc. in Duncan, Okla. in the Easywell wellbore isolation system.

In an embodiment, the swelling agent may comprise an aqueous fluid, alternatively, a substantially aqueous fluid, as will be described herein in greater detail. In an embodiment, a substantially aqueous fluid comprises less than about 50% of a nonaqueous component, alternatively less than about 35%, 20%, 5%, 2% of a nonaqueous component. In an embodiment, the swelling agent may further comprise an inorganic monovalent salt, multivalent salt, or both. A nonlimiting example of such a salt includes sodium chloride. The salt or salts in the swelling agent may be present in an amount ranging from greater than about 0% by weight to a saturated salt solution. That is, the water may be fresh water or salt water. In an embodiment, the swelling agent comprises seawater.

In an alternative embodiment, the swelling agent comprises a hydrocarbon. In an embodiment, the hydrocarbon may comprise a portion of one or more non-hydrocarbon components, for example less than about 50% of a non-hydrocarbon component, alternatively less than about 35%, 20%, 5%, 2% of a non-hydrocarbon component. Examples of such a hydrocarbon include crude-oil, diesel, natural gas, and combinations thereof. Other such suitable hydrocarbons will be known to one of skill in the art.

In an embodiment, the swellable material refers to a material that is capable of absorbing water and swelling, i.e., increases in size as it absorbs the water. In an embodiment, the swellable material forms a gel mass upon swelling that is effective for shock attenuation. In some embodiments, the gel mass has a relatively low permeability to fluids used to service a wellbore, such as a drilling fluid, a fracturing fluid, a sealant composition (e.g., cement), an acidizing fluid, an injectant, etc., thus creating a barrier to the flow of such fluids. A gel refers to a crosslinked polymer network swollen in a liquid. The crosslinker may be part of the polymer and thus may not leach out of the gel. Examples of suitable swelling agents include superabsorbers, absorbent fibers, wood pulp, silicates, coagulating agents, carboxymethyl cellulose, hydroxyethyl cellulose, synthetic polymers, or combinations thereof.

The swellable material may comprise superabsorbers. Superabsorbers are commonly used in absorbent products, such as horticulture products, wipe and spill control agents, wire and cable water-blocking agents, ice shipping packs, diapers, training pants, feminine care products, and a multitude of industrial uses. Superabsorbers are swellable, crosslinked polymers that, by forming a gel, have the ability to absorb and store many times their own weight of aqueous liquids. Superabsorbers retain the liquid that they absorb and typically do not release the absorbed liquid, even under pressure. Examples of superabsorbers include sodium acrylate-based polymers having three dimensional, network-like molecular structures. The polymer chains are formed by the reaction/joining of hundreds of thousands to millions of identical units of acrylic acid monomers, which have been substantially neutralized with sodium hydroxide (caustic soda). Crosslinking chemicals tie the chains together to form a three-dimensional network, which enable the superabsorbers to absorb water or water-based solutions into the spaces in the molecular network and thus form a gel that locks up the liquid. Additional examples of suitable superabsorbers include crosslinked polyacrylamide; crosslinked polyacrylate; crosslinked hydrolyzed polyacrylonitrile; salts of carboxyalkyl starch, for example, salts of carboxymethyl starch; salts of carboxyalkyl cellulose, for example, salts of carboxymethyl cellulose; salts of any crosslinked carboxyalkyl polysaccharide; crosslinked copolymers of acrylamide and acrylate monomers; starch grafted with acrylonitrile and acrylate monomers; crosslinked polymers of two or more of allylsulfonate, 2-acrylamido-2-methyl-1-propanesulfonic acid, 3-allyloxy-2-hydroxy-1-propane-sulfonic acid, acrylamide, and acrylic acid monomers; or combinations thereof. In one embodiment, the superabsorber absorbs not only many times its weight of water but also increases in volume upon absorption of water many times the volume of the dry material.

In an embodiment, the superabsorber is a dehydrated, crystalline (e.g., solid) polymer. In other embodiments, the crystalline polymer is a crosslinked polymer. In an alternative embodiment, the superabsorber is a crosslinked polyacrylamide in the form of a hard crystal. A suitable crosslinked polyacrylamide is the DIAMOND SEAL polymer available from Baroid Drilling Fluids, Inc., of Halliburton Energy Services, Inc. The DIAMOND SEAL polymer used to identify several available superabsorbents are available in grind sizes of 0.1 mm, 0.25 mm, 1 mm, 2 mm, 4 mm, and 14 mm. The DIAMOND SEAL polymer possesses certain qualities that make it a suitable superabsorber. For example, the DIAMOND SEAL polymer is water-insoluble and is resistant to deterioration by carbon dioxide, bacteria, and subterranean minerals. Further, the DIAMOND SEAL polymer can withstand temperatures up to at least 250° F. without experiencing breakdown and thus may be used in the majority of locations where oil reservoirs are found. An example of a biodegradable starch backbone grafted with acrylonitrile and acrylate is commercially available from Grain Processing Corporation of Muscantine, Iowa as WATER LOCK.

As mentioned previously, the superabsorber absorbs water and is thus physically attracted to water molecules. In the case where the swellable material is a crystalline crosslinked polymer, the polymer chain solvates and surrounds the water molecules during water absorption. In effect, the polymer undergoes a change from that of a dehydrated crystal to that of a hydrated gel as it absorbs water. Once fully hydrated, the gel usually exhibits a high resistance to the migration of water due to its polymer chain entanglement and its relatively high viscosity. The gel can plug permeable zones and flow pathways because it can withstand substantial amounts of pressure without being dislodged or extruded.

The superabsorber may have a particle size (i.e., diameter) of greater than or equal to about 0.01 mm, alternatively greater than or equal to about 0.25 mm, alternatively less than or equal to about 14 mm, before it absorbs water (i.e., in its solid form). The larger particle size of the superabsorber allows it to be placed in permeable zones in the wellbore, which are typically greater than about 1 mm in diameter. As the superabsorber undergoes hydration, its physical size may increase by about 10 to about 800 times its original volume. The resulting size of the superabsorber is thus of sufficient size to flow and attenuate shock when the perforation gun 50 is fired. It is to be understood that the amount and rate by which the superabsorber increases in size may vary depending upon temperature, grain size, and the ionic strength of the carrier fluid. The temperature of a well typically increases from top to bottom such that the rate of swelling increases as the superabsorber passes downhole. The rate of swelling also increases as the particle size of the superabsorber decreases and as the ionic strength of the carrier fluid, as controlled by salts, such as sodium chloride or calcium chloride, decreases and vice versa.

The swell time of the superabsorber may be in a range of from about one minute to about thirty-six hours, alternatively in a range of from about three minutes to about twenty-four hours, alternatively in a range of from about four minutes to about sixteen hours, alternatively in a range of from about one hour to about six hours.

In an embodiment, the shock attenuator material 56 embeds or encapsulates bodies and/or particles of plastic, ceramic, glass, metal, or other material. In this embodiment, the shock attenuator material 56 comprises bodies and/or particles in addition to other material, for example swellable material. In an embodiment, the bodies and/or particles may have any form or shape. The bodies and/or particles may be generally bead-shaped, sphere-shaped, pyramid shaped, diamond shaped, ovoid-shaped, or shaped in some other form. The bodies and/or particles may be one or more geometrical shape with rounded and/or beveled edges and/or apexes. The bodies and/or particles may comprise powder. The embedded bodies and/or particles may promote reducing sliding friction between the shock attenuator material 56 and other surfaces such as a casing. The embedded bodies and/or particles may promote ease of abrasion and break-up of the shock attenuator material 56 when the perforation gun string 32 is removed from the wellbore 12. The volume of embedded bodies and/or particles contained per unit volume of the shock attenuator material 56 may be employed as a design variable to adjust the amount of swelling that the shock attenuator material 56 undergoes when exposed to swelling agents in the wellbore 12.

Figure 3A:
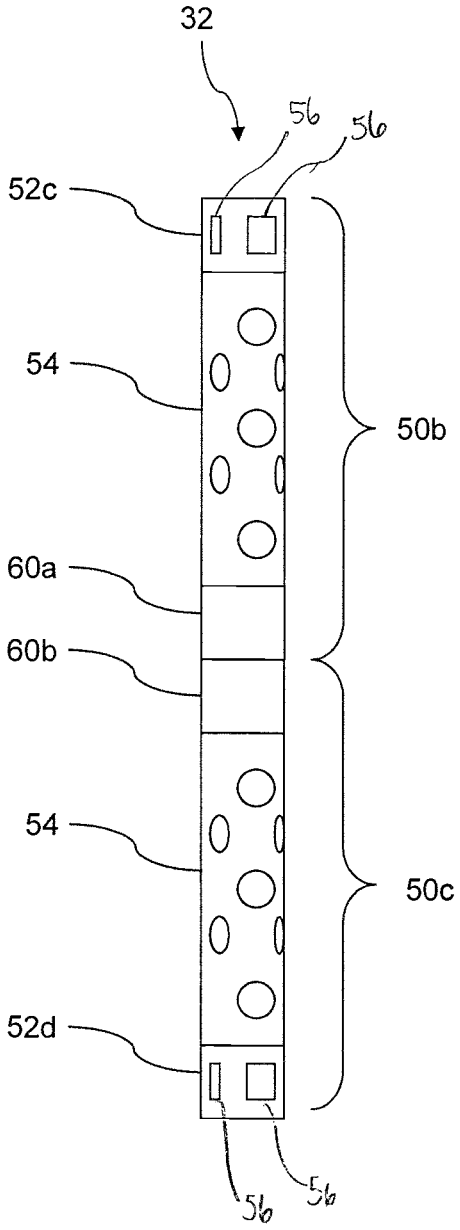
FIG. 3A is an illustration of a perforation gun string according to an embodiment of the disclosure.

Turning now to FIG. 3A, FIG. 3B, FIG. 3C, and FIG. 3D, several alternative embodiments of the perforation gun string 32 are described. As illustrated in FIG. 3A, the perforation gun string 32 may comprise a second perforation gun 50*b* and a third perforation gun 50*c*. Each of the perforation guns 50*b*, 50*c* are substantially similar to the first perforation gun 50*a*, with the exception that only one of the tandems in each perforation gun 50*b*, 50*c* comprises shock attenuation material 56. The second perforation gun 50*b* comprises a third tandem 52*c* having shock attenuation material, a perforation gun barrel 54, and a first standard tandem 60*a*, where the first standard tandem 60*a* does not feature shock attenuation material. The third perforation gun 50*c* comprises a fourth tandem 52*d* having shock attenuation material 56, a perforation gun barrel 54, and a second standard tandem 60*b*, where the second standard tandem 60*b* does not feature shock attenuation material. The distance between the tandem 52*c* and the tandem 52*d* may be deemed suitable for providing a desired amount of shock attenuation.

Figure 3B:
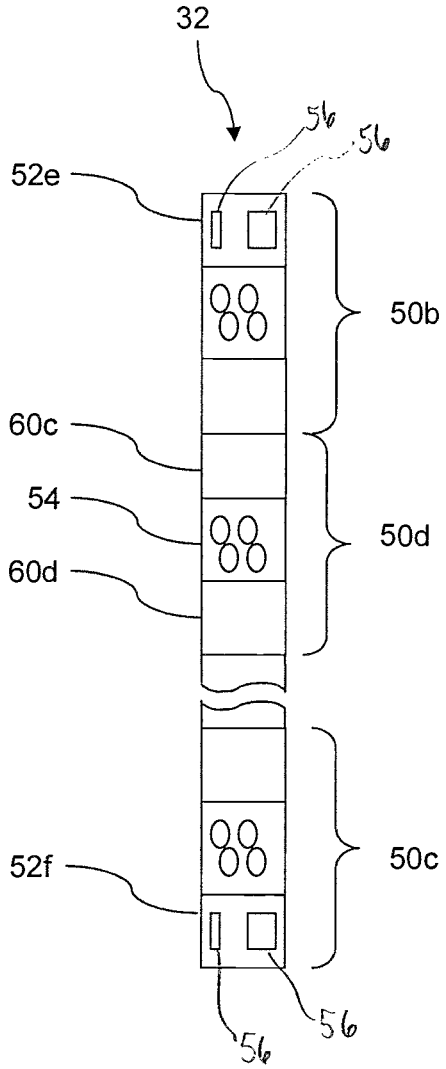
FIG. 3B is an illustration of a perforation gun string according to an embodiment of the disclosure.

As illustrated in FIG. 3B, the perforation gun string 32 may comprise more than two perforation guns 50, where the top perforation gun is configured like the second perforation gun 50*b* and the bottom perforation gun is configured like the third perforation gun 50*c* described with reference to FIG. 3A. One or more perforation guns 50*d* may be coupled into the perforation gun string 32 between the perforation guns 50*b*, 50*c*. For example, the fourth perforation gun 50*d* may comprise standard tandems 60*c* and 60*d* that do not feature shock attenuation material. Again, the distance between the tandem 52*e* and the tandem 52*f* may be deemed suitable for providing a desired amount of shock attenuation.

Figure 3C:
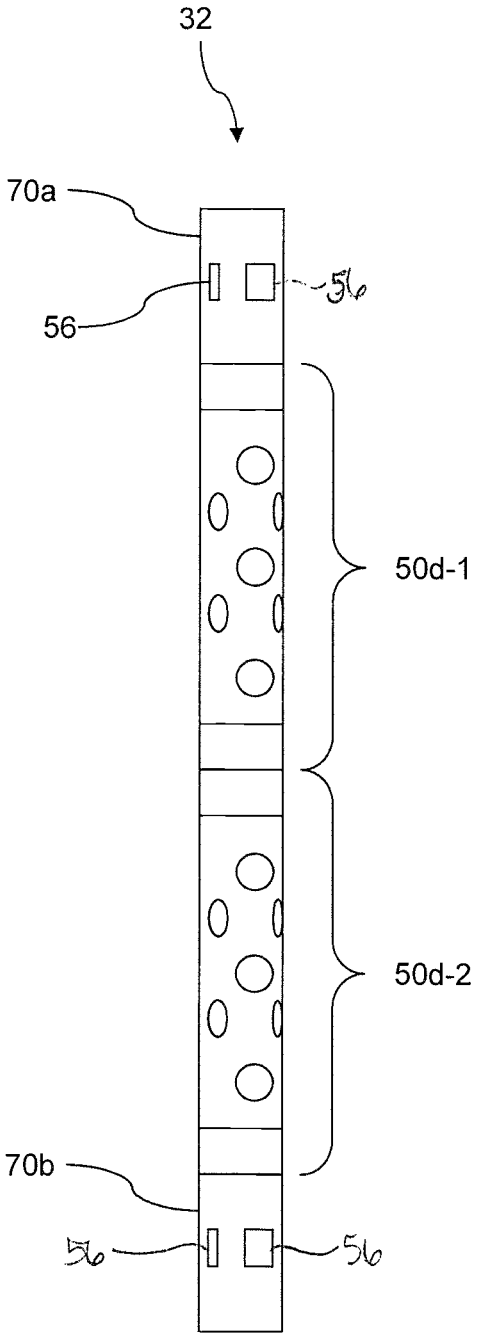
FIG. 3C is an illustration of a perforation gun string according to an embodiment of the disclosure.
Figure 3D:
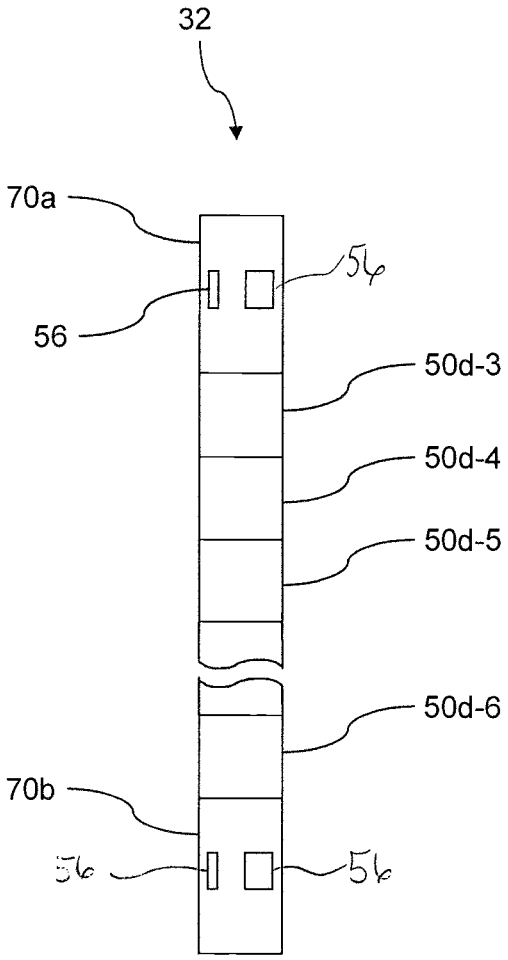
FIG. 3D is an illustration of a perforation gun string according to an embodiment of the disclosure.

As illustrated in FIG. 3C, the perforation gun string 32 may comprise two perforation guns 50*d*-1, 50*d*-2, a first subassembly 70*a*, and a second subassembly 70*b*. The two perforation guns 50*d*-1, 50*d*-2 do not feature any shock attenuation material. Both the subassemblies 70*a*, 70*b* feature shock attenuation material 56. As with the description above, the shock attenuation material may be provided in a variety of shapes and disposed in a variety of locations around the radial surface or subsurface of the subassemblies 70*a*, 70*b*. As illustrated in FIG. 3D, in an embodiment, the perforation gun string 32 may comprise any number of perforation guns 50*d* between the end subassemblies 70*a*, 70*b*. As illustrated, in an embodiment, the perforation gun string 32 may comprise a third perforation gun 50*d*-3, a fourth perforation gun 50*d*-4, a fifth perforation gun 50*d*-5, and a sixth perforation gun 50*d*-6. It is understood that the perforation gun string 32 may be embodied with other numbers of perforation guns 50*d* coupled between the end subassemblies 70*a*, 70*b*, including a single perforation gun 50*d*. In the embodiments described above, it is understood that additional connectors, spacers, tools, and subassemblies could be used between guns 50 and likewise could have shock attenuation material 56 coupled to them.

Figure 4:
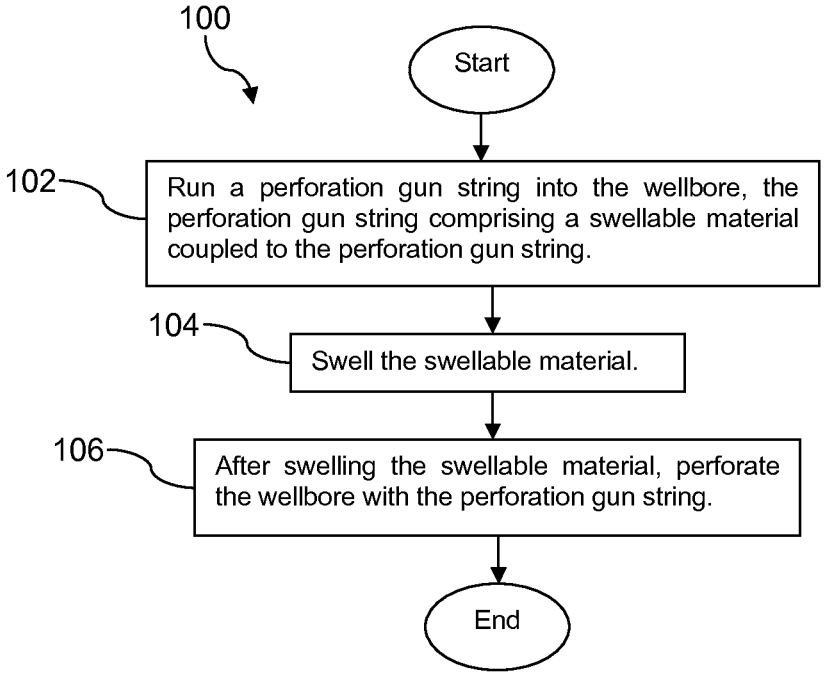
FIG. 4 is a flow chart of a method according to an embodiment of the disclosure.

Turning now to FIG. 4, a method 100 is described. At block 102, a perforation gun string is run into the wellbore, the perforation gun string comprising a swellable material coupled to the perforation gun string. For example, one of the perforation gun strings 32 described above or another embodiment of the gun string 32 is run into the wellbore 12. At block 104, the swellable material coupled to the perforation gun string is swelled. For example, the shock attenuator material 56 swells over time in response to downhole environmental conditions, such as contact with water, contact with hydrocarbons, exposure to elevated temperature, and/or other downhole environmental conditions. At block 106, after the swellable material has swollen, the wellbore is perforated using the perforation gun string, for example the explosive charges 58 are activated.

In an embodiment, after the perforation event, other procedures may be performed, for example a flow test may be performed. In an embodiment, after perforating the wellbore 12 the gun string 32 may be left in the wellbore 12 to allow other swellable material to swell, where the other swellable material swells at a slower rate than the swellable material employed for shock attenuation. The other swellable material may be used to seal a zone of the wellbore 12 while performing some other procedure, for example capturing a sample by a subassembly of the work string 18.

In an embodiment, the method 100 may further comprise removing the shock attenuator material 56 from the perforation gun string 32 and removing the perforation gun string 32 from the wellbore 12. For example, the shock attenuator material 56 may shear off from the perforation gun string 32 as the perforation gun string is removed from the wellbore 12. In an embodiment, the shock attenuator material 56 may be sheared off in response to engaging a side of the wellbore 12 and/or a wellbore tubular wall and/or in response to engaging a restriction in the wellbore 12. The shock attenuator material 56 may abrade off of and/or slice (e.g., shear) off of the perforation gun string 32. For example, upon encountering a restriction, the shock attenuator material 56 may be sheared due to the force applied by the smaller diameter component at or near the diameter of the smaller diameter component. The shock attenuator material 56 removed from the perforating gun string 32 may fall to the bottom of the wellbore 12 where it may remain or be removed in a subsequent retrieval operation. Alternatively, the shock attenuator material 56 may, at least in part, dissolve. When the shock attenuator material 56 is removed from the perforating gun string 32, the pieces may be small enough and/or light enough to be entrained with a produced fluid and removed from the wellbore 12 without requiring a separate retrieval operation.

In an embodiment, the perforation gun string 32 may be modeled with a perforation gun firing simulation computer program such as the ShockPro simulation program. This simulation may promote a designer of the perforation gun string 32 to evaluate different embodiments of the perforation gun string 32 and choose an implementation and/or embodiment that is suitable to the subject planned perforation job. Some of the parameters that may be taken into consideration in selecting one implementation from a plurality of alternative embodiments of the perforation gun string 32 may be the number of explosive charges 58 in the gun barrel 54, the location of the explosive charges 58 in the gun barrel 54, the characteristics of the explosive charges 58 such as whether they are "big hole" or "small hole" charges and the energy associated with the charges, the number of perforation guns 50 in the perforation gun string 32, and other design parameters. The characteristics of the wellbore 12 may be taken into consideration in selecting an embodiment of the perforation gun string 32, for example, the presence of any narrow constrictions in the wellbore 12 may be taken into consideration.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A perforation gun string for use in perforating a wellbore, comprising:

a perforation gun, wherein the perforation gun forms at least a part of the perforation gun string; and sections of a swellable material coupled to and spatially located around the perforation gun string, wherein the sections of the swellable material are configured to be exposed to a downhole wellbore environment and to swell and protrude beyond an outer surface of the perforation string in response to exposure to the downhole wellbore environment, and wherein the sections of the swellable material are spatially arranged to form one or more longitudinal fluid gaps between adjacent sections of the swellable material, the gaps being configured to allow fluid flow therebetween.

2. The perforation gun string of claim 1, further comprising a tandem coupled to the perforation gun, wherein the sections of the swellable material are coupled to the tandem.

3. The perforation gun string of claim 1, wherein the sections of the swellable material are coupled to the perforation gun.

4. The perforation gun string of claim 1, further comprising a subassembly coupled to the perforation gun, wherein the sections of the swellable material are coupled to the subassembly.

5. The perforation gun string of claim 1, wherein the sections of the swellable material comprises one of low acrylicnitrile, ethylene propylene diene rubber, or a cross-linked polyacrylamide.

6. The perforation gun string of claim 1, wherein the sections of the swellable material are coupled to the perforation gun string in cavities of the perforation gun string.

7. A downhole tool, comprising:

a tandem for use in making up a perforation gun; and sections of a swellable material coupled to the tandem, wherein the sections of the swellable material are configured to swell in response to being exposed to a downhole wellbore environment, wherein the sections of the swellable material are configured to permit fluid flow between an annular region above the sections of the swellable material and an annular region below the sections of the swellable material after the sections of the swellable material swell, and wherein the sections of the swellable material are spatially arranged to form one or more longitudinal fluid gaps between adjacent sections of the swellable material.

8. The downhole tool of claim 7, wherein the tandem comprises a surface cavity and the sections of the swellable material are retained within the surface cavity.

9. The downhole tool of claim 7, wherein the sections of the swellable material comprise a plurality of separate pieces, and wherein each piece of swellable material is retained within a corresponding surface cavity of the tandem.

10. The downhole tool of claim 7, wherein the sections of the swellable material comprise particles, and wherein the particles comprise one or more of bead-shaped particles, sphere-shaped particles, ovoid particles, or powder.

11. The downhole tool of claim 7, wherein the sections of the swellable material are shaped to have one of a beveled edge and a ramp-shaped edge after swelling.

12. The downhole tool of claim 7, wherein the sections of the swellable material are layered.

13. The downhole tool of claim 12, wherein the sections of the swellable material have an outer hard layer and an inner soft layer.

14. A method of perforating a wellbore, comprising:

running a perforation gun string into the wellbore to a perforation depth, the perforation gun string comprising sections of swellable material coupled to and spatially located around the perforation gun string;

allowing the sections of the swellable material to swell, wherein the sections of the swellable material are spatially arranged to form one or more longitudinal fluid gaps between adjacent sections of the swellable material; and perforating the wellbore after the sections of the swellable material swell.

15. The method of claim 14, wherein the sections of the swellable material are coupled to a first tandem located above a perforation gun and coupled to a second tandem located below the perforation gun.

16. The method of claim 15, wherein the sections of the swellable material allows fluid flow between an annular region above the first tandem and a region below the second tandem.

17. The method of claim 14, further comprising during the perforating, the sections of the swellable material are configured to attenuate an impact between the perforation gun and a wall of the wellbore.

18. The method of claim 14, wherein the sections of the swellable material comprises one of low acrylic-nitrile, ethylene propylene diene rubber, or a cross-linked polyacrylamide.

19. The method of claim 14, wherein the sections of the swellable material are molded to have a beveled edge after swelling.

* * * * *

UNITED STATES PATENT AND TRADEMARK OFFICE

CERTIFICATE OF CORRECTION

PATENT NO. : 9,297,228 B2
APPLICATION NO. : 13/820748
DATED : March 29, 2016
INVENTOR(S) : Samuel Martinez and John H. Hales It is certified that error appears in the above-identified patent and that said Letters Patent is hereby corrected as shown below:

In the claims,

Column 12, lines 47-48, "the perforation string" should read -- the perforation gun string --.

Column 12, line 65, "swellable material comprises" should read -- swellable material comprise --.

Column 14, line 28, "swellable material comprises" should read -- swellable material comprise --.

Signed and Sealed this
Twenty-eighth Day of June, 2016

Michelle K. Lee

Michelle K. Lee
*Director of the United States Patent and Trademark Office*